United States Patent [19]

Spees

[11] Patent Number: 4,494,659

[45] Date of Patent: Jan. 22, 1985

[54] COMPRESSOR FOR MICROFICHE CARDS AND THE LIKE

[75] Inventor: Arthur T. Spees, Villa Park, Calif.

[73] Assignee: Visu-Flex Company, Pico Rivera, Calif.

[21] Appl. No.: 491,088

[22] Filed: May 3, 1983

[51] Int. Cl.[3] ..... A47F 7/00

[52] U.S. Cl. ..... 211/51; 211/DIG. 1; 312/183

[58] Field of Search ..... 211/51, DIG. 1, 11, 211/43, 45; 312/183, 190

[56] References Cited

U.S. PATENT DOCUMENTS

| | | | |
|---|---|---|---|
| 1,424,080 | 7/1922 | Carpenter | 312/190 |
| 2,693,192 | 11/1954 | James | 211/DIG. 1 |
| 2,702,553 | 2/1955 | Regenhardt | 211/DIG. 1 |
| 3,550,979 | 12/1970 | Protzmann | 312/183 |
| 3,556,621 | 1/1971 | Blakley | 312/183 |
| 3,696,926 | 10/1972 | Syversen | 312/183 X |
| 3,780,873 | 12/1973 | Silva | 211/51 X |
| 3,814,490 | 6/1974 | Dean et al. | 211/51 X |
| 4,130,203 | 12/1978 | Russell | 211/51 |

*Primary Examiner*—Robert W. Gibson, Jr.
*Attorney, Agent, or Firm*—Gordon L. Peterson

[57] ABSTRACT

A compressor for cards stored in a drawer of magnetic material comprising a base positionable in the drawer and a compressor member mounted on the base for pivotal movement relative to the base between an extended position in which the compressor member can support the cards in a vertical position and a retracted position in which the compressor member is retracted from the cards. A spring biases the compressor member toward the extended position. A first magnet section on the base cooperates with the magnetic material of the drawer for magnetically retaining the compressor on the drawer. A second magnet section on the base retains the compressor member in the retracted position against the biasing force of the spring.

17 Claims, 3 Drawing Figures

COMPRESSOR FOR MICROFICHE CARDS AND THE LIKE

BACKGROUND OF THE INVENTION

Various cards, such as microfiche cards, microfilm jackets and aperture cards are stored in trays or drawers. It is common practice to use compressors or follow-blocks to keep the cards compressed in a compact, vertical position within the drawer.

One common form of compressor is fitted into a track in the bottom of the drawer in such a manner as to be adjustable lengthwise so as to hold different numbers of cards in a vertical orientation. One limitation of this kind of compressor is that the compressor must be released and pushed away from the cards in order to gain access to one or more of the cards. Following this, the compressor must be readjusted up against the cards to hold them in the vertical position. Because of this inconvenience, this type of compressor is most often employed with files which are not used frequently.

In more active card files, wobble blocks or rigid dividers which could be inclined forward and backward in a "V" angle are used. However, with wobble blocks, filing space is lost due to the inability to fully use the space between the wobble blocks.

In another prior art compressor, the compressor is magnetically retained on the bottom of the drawer and has a compressor member spring biased to a forward position to engage the cards and retain them in a vertical position. One problem with this compressor is that the compressor member must be manually held in a rearward position in order to gain access to the cards, and this leaves only one hand free to locate and withdraw the card or cards or interest.

SUMMARY OF THE INVENTION

This invention provides a compressor which generally overcomes the problems identified above. The compressor of this invention uses a compressor member which is, in effect, bistable. In an extended position of the compressor member, the cards are firmly held in a vertical position, and in a retracted position, the compressor member is retracted from the cards to facilitate access thereto.

The compressor of this invention is adapted for use in a tray or drawer having a magnetic region, such as a magnetic bottom. The magnetic region is not a magnet but contains ferromagnetic material or the like which is attracted to a magnet. The compressor can advantageously include a base positionable in the drawer and a compressor member mounted on the base for movement relative to the base between an extended position in which the compressor member can support the cards in a vertical position and a retracted position in which the compressor member is retracted from the cards.

Resilient means, such as a spring, biases the compressor member toward the extended position, and a magnet section on the base retains the compressor member in the retracted position against the biasing force of the resilient means. This frees both hands of the user for use in manipulating the cards. When a releasing force is manually applied to the compressor member, the compressor member is freed from the magnet, and the spring moves the compressor member toward the extended position.

To retain the compressor in position in the drawer, a magnet section on the base cooperates with the magnetic region of the drawer. Preferably, both of the magnetic sections are portions of the same magnet. The magnetic force between the magnet and the drawer must be sufficient to retain the compressor in position and to support the cards vertically. It must also be sufficient to retain the compressor in this position when the releasing force is applied to the compressor member.

In a preferred construction, at least a portion of the base is of magnetic material. To prevent bleeding of the magnetic force through the base, the compressor preferably includes nonmagnetic means for insulating the magnet from the base. The nonmagnetic means may include an air gap and/or other nonmagnetic material. To provide for a strong magnetic retention force to the drawer, the magnet preferably engages the drawer and the base includes feet of nonmagnetic material spaced from the magnet which also engage the drawer.

The compressor member may be mounted on the base for movement along various different paths in moving between the extended and retracted positions. However, preferably the compressor member is mounted on the base for pivotal movement between such positions.

The invention, together with additional features and advantages thereof, may best be understood by reference to the following description taken in connection with the accompanying illustrative drawing.

DESCRIPTION OF THE PREFERRED EMBODIMENT

Figure 1:
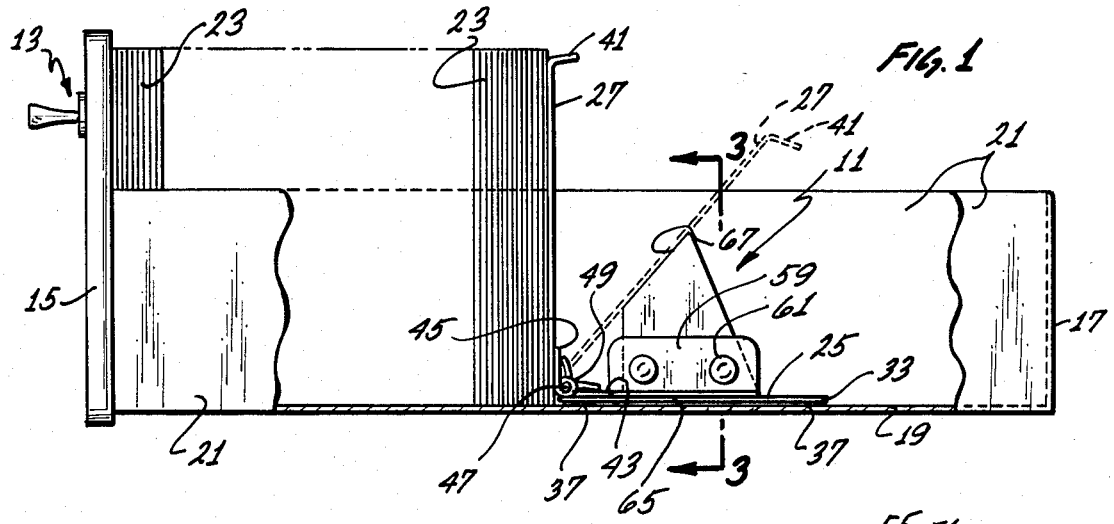
FIG. 1 is a side elevational view partially in section showing a compressor constructed in accordance with the teachings of this invention being used in a file drawer.

FIG. 1 shows a compressor 11 in a file drawer 13. Although the file drawer 13 may be of various different constructions, in the illustrated embodiment, it includes a front panel 15, a back panel 17, a bottom 19 and spaced parallel side walls 21. All or a selected region of the drawer 13 may be constructed of magnetic material, and in the embodiment illustrated, the bottom 19 is constructed of ferrous metal.

The drawer 13 may be used with a cabinet in a conventional manner. The drawer 13 provides a rectangular storage chamber for cards, such as microfiche cards 23. The compressor 11 is adapted to hold the cards 23 in the vertical, compressed condition shown in FIG. 1.

Figure 3:
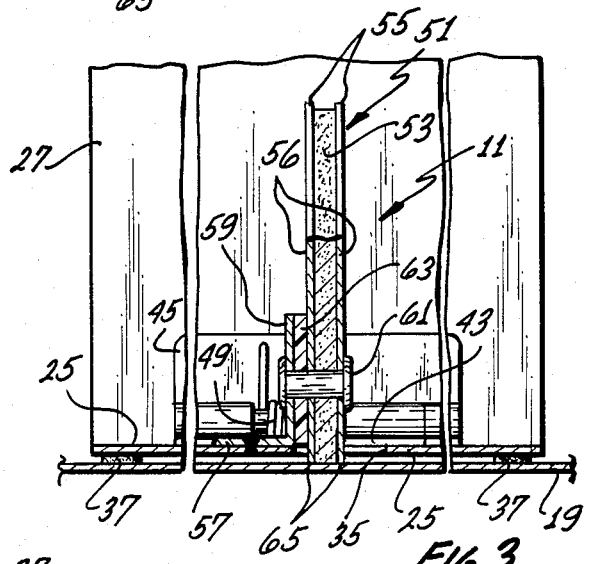
FIG. 3 is an enlarged fragmentary view partly in section taken generally along line 3—3 of FIG. 1.

The compressor 11 comprises a base in the form of a base plate 25 and a compressor member in the form of a compressor plate 27 mounted on the base plate for pivotal movement by a hinge 29. In the form illustrated, the base plate 25 is constructed of ferrous sheet metal and it has a forward edge 31, a rear edge 33 and an opening 35. The base also includes four feet 37 of suitable nonmagnetic material adhered to the base plate 25 adjacent the four corners thereof. When the compressor 11 is placed on the bottom 19 of the drawer 13, the compressor is supported, in part, by the feet 37, and the base plate 25 is spaced slightly upwardly from the bottom 19 as shown in FIG. 3.

The compressor plate 27 is constructed of ferromagnetic sheet material and has an inner edge 39 and an integral flange 41 along an outer edge. Except for the flange 41, the compressor plate 27 is essentially planar.

The hinge 29 may be conventional and comprises plates 43 and 45 spot welded to the base plate 25 and the compressor plate 27, respectively, and hinged together by a pin 47. A spring 49 is wound on the pin 47 and biases the compressor plate 27 counterclockwise toward an extended position in which the compressor plate is essentially vertical as shown in full lines in FIG. 3. The compressor plate 27 may also be considered to be in the extended position in the dashed-line position of FIG. 3 which corresponds to the full-line position of FIG. 1 in which the compressor plate engages and supports the cards 23. In the embodiment illustrated, the spring 49 can pivot the compressor plate 27 forwardly beyond the vertical position until an inner edge portion of the compressor plate 27 contacts the forward edge 31 of the base plate as shown in full lines in FIG. 3. Thus, in the vertical position shown in FIG. 1, the compressor plate 27 biases the cards 23 to a compressed vertical position.

Figure 2:
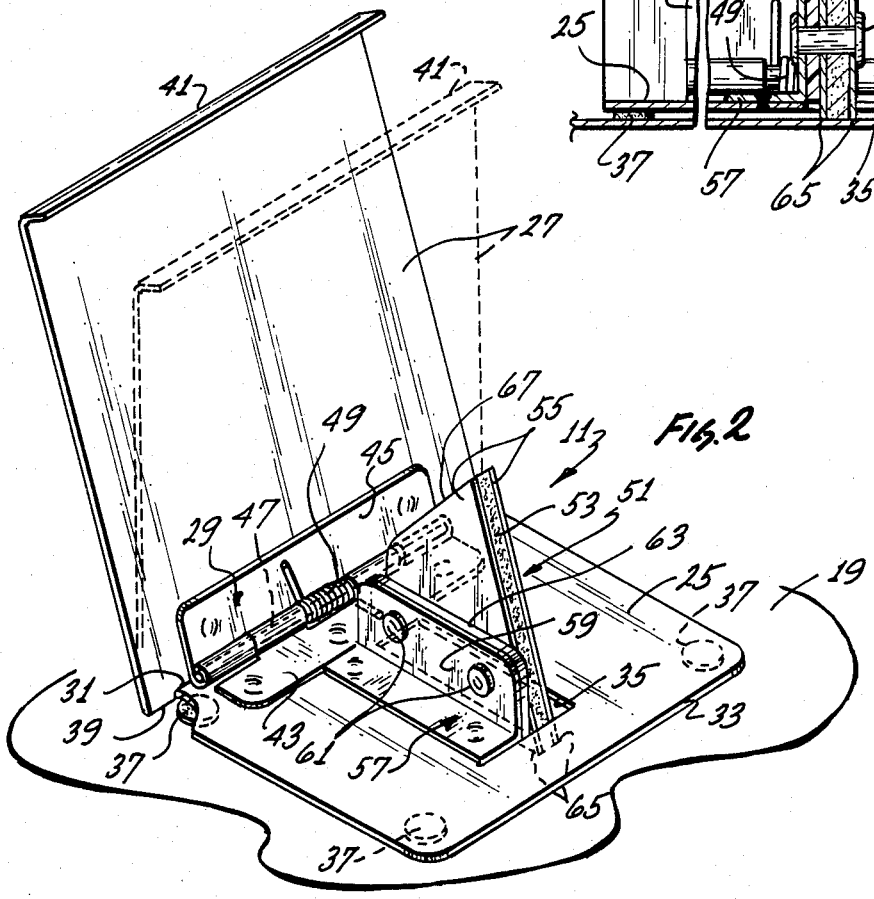
FIG. 2 is a perspective view of the compressor with the compressor member in the extended position.

The compressor plate 27 can be magnetically retained in a retracted position as shown in dashed lines in FIG. 1, and for this purpose, a permanent magnet 51 is provided. Although the magnet 51 may be of different constructions, in the embodiment illustrated, it includes a core magnet 53 which may include plastic material and identical pole plates 55 which sandwich the core magnet 53 between them. The core magnet 53 is recessed inwardly from the peripheries of the pole plates 55 as shown in FIG. 3 and has opposed, broad, parallel faces 56 (FIG. 2) which are entirely of opposite polarities with the central plane through the core magnet parallel to the faces 56 being neutral. This provides greater magnetic force along the edges of the pole plates 55 than if each of the faces 56 was of alternating polarity along its length.

The magnet 51 is mounted on the base plate 25, and nonmagnetic means is used to magnetically insulate the magnet 51 from the base plate 25. For this purpose, the magnet 51 is positioned in the opening 35 in spaced relationship to the edges of the opening to define a gap or clearance space all around the magnet 51 as shown in FIG. 3. The magnet 51 is mounted on the base plate 25 by an angle member 57 of magnetic material which is spot welded to the base plate and which has a flange 59 extending vertically along one edge of the opening 35. Suitable nonmagnetic fasteners 61, such as rivets or screws, mount the magnet 51 on the flange 59. Nonmagnetic material, such as a strip 63 of plastic, is retained between the flange 59 and the magnet 51. Accordingly, the opening 35 and the strip 63 constitute nonmagnetic means which insulate the magnet from the base plate 25 and the angle member 57.

When mounted in this fashion, the plane of the magnet 51 extends vertically, and it forms, in effect, two magnet sections. The first of these magnet sections includes lower edges 65 of the pole plates 55 which project through the opening 35 and below the plane of the base plate 25 and into the plane of the free ends of the feet 37. Thus, with the compressor 11 on the bottom 19 of the drawer 13, the compressor is supported by the feet 37 and by the lower edges 65 of the pole plates 55. Although contact between the edges 65 and the bottom 19 is preferred, it is nonessential. This magnetically retains the compressor 11 on the bottom 19 of the drawer 13 with a first magnetic force. This force is sufficient to retain the compressor in position on the bottom 19 and to hold the cards 23 in a compressed vertical position.

A second magnet section is used to magnetically retain the compressor plate 27 in the retracted position. This second magnet section comprises inclined edges 67 of the pole plates 55. The edges 67 are inclined at an acute angle relative to the base plate 25 and to the edges 65, and this acute angle, in the illustrated embodiment, equals the angle that the compressor plate 27 forms with the base plate 25 in the retracted position. For example, the plane of the inclined edges 67 may form an included angle with the base plate 25 of about 45 degrees. This magnet section must be sufficiently strong to retain the compressor plate 27 in the retracted position against the biasing force of the spring 49.

The compressor plate 27 can be manually released from the magnet 51 by applying a releasing force in the same direction as the spring 49 to release the compressor plate 27 from the magnet 51 for movement toward the extended position. The magnetic force holding the compressor 11 on the bottom 19 must be sufficient to hold the compressor in position when the manual releasing force is applied to the compressor plate 27. Preferably, the magnetic force holding the compressor 11 on the bottom 19 is greater than the magnetic force holding the compressor plate 27 in the retracted position. This can be achieved, for example, by making the edges 65 longer than the edges 67. In addition, the magnet 51 tends to direct its greater force through the edges 65 which first contact a ferromagnetic surface.

In use, the compressor 11 is placed on the bottom 19 of the drawer 13 and pushed toward the front panel 15 to compress the cards 23 as shown in full lines in FIG. 1. In this position, the compressor 11 is held strongly against the bottom 19 by the magnet 51, and more specifically, the lower edges 65. The base plate 25 is isolated from the magnet 51 as described above, and the nonmagnetic feet 37 magnetically insulate the base plate from the bottom 19. The compressor plate 27 is in the extended position in which it engages the cards 23 and holds them in a compressed, upright position.

When access to the cards 23 is desired, the compressor plate 27 is pivoted manually to the retracted position shown in dashed lines in FIG. 1 where the inclined edges 67 magnetically retain the compressor plate. This removes the compressive force on the cards 23 so that access to the cards can be obtained. The magnetic force holding the compressor in position on the bottom 19 is sufficiently strong so that the compressor does not move rearwardly toward the back panel 17 when the compressor plate 27 is being pivoted to the retracted position against the biasing force of the spring 49. With the compressor plate 27 magnetically retained, both of the user's hands are free to manipulate the cards 23. Thereafter, the compressor plate 27 can be manually freed from the magnetic force to allow the spring 49 to move it to the extended position.

Although an exemplary embodiment of the invention has been shown and described, many changes, modifications and substitutions may be made by one having ordinary skill in the art without necessarily departing from the spirit and scope of this invention.

I claim:

1. A compressor for cards in a drawer having a magnetic region, said compressor comprising:

a base positionable in the drawer;

a compressor member;

means for mounting the compressor member on the base for movement relative to the base between an extended position in which the compressor member can support the cards and a retracted position in which the compressor member is retracted from the cards;

resilient means for biasing the compressor member toward the extended position;

a first magnet section on said base for cooperating with the magnetic region of the drawer for magnetically retaining the compressor on the drawer with a first magnetic force; and a second magnet section on the base for retaining the compressor member in said retracted position with a second magnetic force against the biasing force of the resilient means whereby by applying a releasing force to the compressor member, the biasing means can move the compressor member to the extended position.

2. A compressor as defined in claim 1 wherein said mounting means mounts the compressor member on the base for pivotal movement between said extended position and said retracted position.

3. A compressor as defined in claim 1 wherein said first and second magnet sections include portions of the same magnet.

4. A compressor as defined in claim 1 wherein at least a portion of said base is of magnetic material and said compressor includes nonmagnetic means for insulating the first magnet section from said portion of said base.

5. A compressor as defined in claim 4 wherein said nonmagnetic means includes an air gap.

6. A compressor as defined in claim 1 wherein the first magnetic force is greater than the second magnetic force.

7. A compressor as defined in claim 1 wherein said base includes downwardly projecting feet of nonmagnetic material and said feet and said magnet are engageable with the magnetic region of the drawer.

8. A compressor as defined in claim 1 wherein said first and second magnet sections include portions of the same magnet, said magnet includes first and second pole plates of magnetic material and a core magnet sandwiched between said pole plates, said core magnet has first and second opposed broad faces confronting the first and second pole plates, respectively, substantially all of said first face being of one polarity and substantially all of said second face being of the other polarity.

9. A compressor as defined in claim 1 wherein said first magnetic force being sufficient to retain the compressor in position on the drawer when the releasing force is applied to the compressor member and sufficient to retain the compressor in position when the compressor member supports the cards.

10. A compressor for cards in a drawer having a magnetic bottom, said compressor comprising:

a base plate positionable on the bottom of the drawer, at least a portion of said base plate being of magnetic material;

a compressor plate;

means for mounting the compressor plate on the base plate for pivotal movement relative to the base plate between an extended position in which the compressor plate can support the cards and a retracted position in which the compressor plate is retracted from the cards;

resilient means for biasing the compressor plate toward the extended position;

a first magnet section;

means for mounting the first magnet section on said base for cooperating with the magnetic bottom of the drawer for magnetically retaining the compressor on the drawer with a first magnetic force;

nonmagnetic means for insulating the first magnet section from said portion of said base plate; and a second magnet section on the base plate for retaining the compressor plate in said retracted position with a second magnetic force against the biasing force of the resilient means whereby by applying a releasing force to the compressor member, the biasing means can move the compressor member to the extended position.

11. A compressor as defined in claim 9 wherein said base plate has an opening having opposed edges and a flange along one of said edges of said opening, said mounting means for said first magnet section includes said flange, said first magnet section extends into said opening and is spaced from said edges to define an air gap and said nonmagnetic means includes at least a portion of said air gap.

12. A compressor as defined in claim 11 wherein said flange includes magnetic material and said nonmagnetic means includes nonmagnetic material between said flange and said first magnet section.

13. A compressor as defined in claim 10 wherein said first and second magnet sections include portions of the same magnet, said first and second magnet sections have faces for engaging the bottom of the drawer and the compressor plate, respectively, and the plane of said faces as viewed in side elevation forms an acute angle.

14. A compressor as defined in claim 10 wherein said first magnet section includes first and second pole plates and a core magnet sandwiched between said pole plates, said base plate includes feet of nonmagnetic material extending below the plane of the base plate and an opening and said pole plates extend into said opening below the plane of the base plate.

15. A compressor as defined in claim 10 wherein said first and second magnet sections include portions of the same magnet, said magnet includes first and second pole plates of magnetic material and a core magnet sandwiched between said pole plates, said core magnet has first and second opposed broad faces confronting the first and second pole plates, respectively, substantially all of said first face being of one polarity and substantially all of said second face being of the other polarity.

16. A compressor as defined in claim 10 wherein said base plate has an opening having opposed edges and a flange along one of said edges of said opening, said mounting means of said first magnet section includes said flange, said first magnet section extends into said opening and is spaced from the other of said edges to define an air gap, said nonmagnetic means includes said air gap and nonmagnetic material between said flange and said first magnet section, said first and second magnet sections having faces for engaging the bottom of the drawer and the compressor plate, respectively, and the plane of said faces as viewed in side elevation forms an acute angle.

17. A compressor as defined in claim 10 wherein said first magnetic force being sufficient to retain the compressor in position when the compressor plate supports the cards.

* * * * *